United States Patent [19]

Miesch

[11] 4,149,397

[45] Apr. 17, 1979

[54] ROLLING MILL

[75] Inventor: Hans Miesch, Zurich, Switzerland

[73] Assignee: Escher Wyss Limited, Zurich, Switzerland

[21] Appl. No.: 841,704

[22] Filed: Oct. 13, 1977

[30] Foreign Application Priority Data

Oct. 21, 1976 [CH] Switzerland ..... 13304/76

[51] Int. Cl.[2] ..... B21B 29/00; B21B 27/10

[52] U.S. Cl. ..... 72/201; 72/241; 72/245

[58] Field of Search ..... 72/201, 241, 242, 245

[56] References Cited

U.S. PATENT DOCUMENTS 3,587,265 6/1971 Sivilotti ..... 72/201 X 4,059,976 11/1977 Christ et al. ..... 72/241 X

*Primary Examiner*—Milton S. Mehr

*Attorney, Agent, or Firm*—Robert A. Ostmann

[57] ABSTRACT

Rolling mill with two working rolls, for rolling a sheet material, a series of hydrostatic supporting devices, supporting one of said said working rolls in the direction of movement of the sheet of material and another series of hydrostatic supporting devices supporting said one of said working rolls opposite to said direction of movement; the working pressures of two of said supporting devices situated opposite one another being variable by amounts which correspond to an equal-magnitude force acting in the plane of the sheet of material.

4 Claims, 4 Drawing Figures

Fig. 1
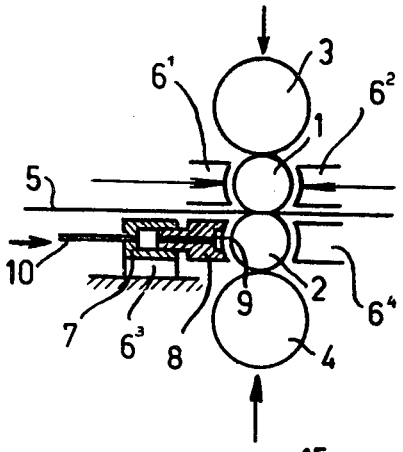
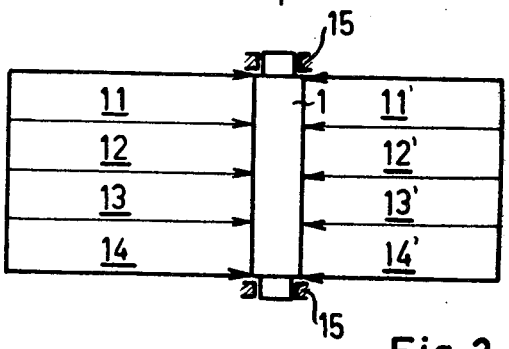
Fig. 2
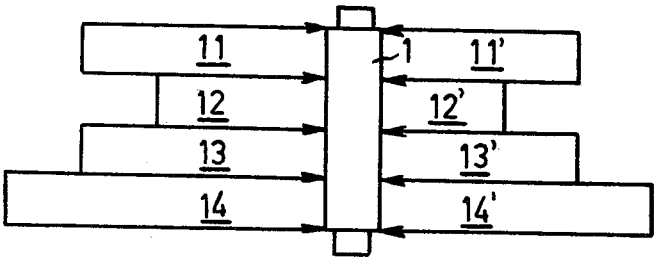
Fig. 3
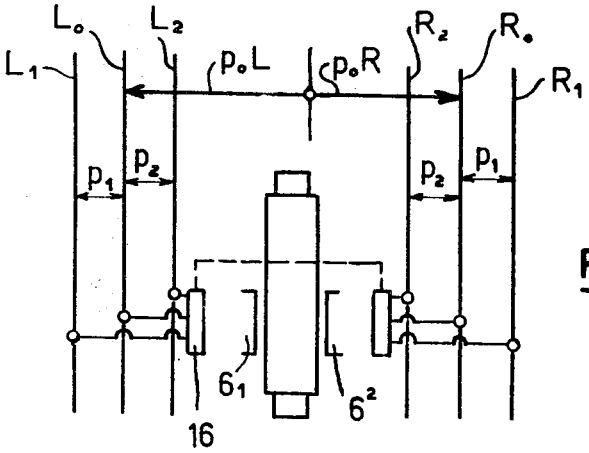
Fig. 4

ROLLING MILL

BACKGROUND OF THE INVENTION

The invention relates to a rolling mill having two working rolls between which a long sheet of material is rolled, the working rolls being supported substantially in the direction of movement of the sheet of material and in the opposite direction thereto by in each case a series of hydrostatic supporting devices.

A rolling mill of that kind has been proposed in U.S. patent application Ser. No. 665,767 filed Feb. 6, 1976, FIG. 3, now U.S. Pat. No. 4,059,976, granted Nov. 29, 1977. In that case the pressure medium of the hydrostatic supporting devices arrives directly at the working rolls, flowing away through a gap between the supporting device and the working roll. Accordingly the pressure medium of the supporting devices is used not only for supporting the working rolls but also for cooling them.

SUMMARY OF THE INVENTION

The invention has as its object to provide a rolling mill wherein the cooling effect of the hydrostatic supporting devices are capable of being varied, more particularly being variable over the width of the roll also.

In a rolling mill of the kind initially described, this object is achieved according to the invention in that the working pressures of two supporting devices which are situated opposite one another are variable by amounts corresponding to an equal-magnitude force acting in the material sheet plane. If the working pressures of the supporting devices are increased for example, by the aforesaid amounts, more working medium flows through the supporting devices and the gap between supporting device and working roll, so that the cooling effect is increased. But since the working pressure variation of one supporting device and the working pressure variation of the opposite other supporting device corresponds to an equal-magnitude force acting in the material sheet plane, the working pressure variations do not result in any variation of the resulting force applied by the two supporting devices to the working roll. Thus, the cooling of the working rolls can be modified without varying the supporting effect on the working rolls.

It is advantageous if the pressure surfaces of the supporting devices situated opposite one another are of equal size, and the working pressures of these supporting devices are variable by equally large pressure amounts.

It is also advantageous if the mutually opposite supporting devices are supplied with pressures which differ from one another by an amount corresponding substantially to the rolling force acting in the material sheet plane.

BRIEF DESCRIPTION OF THE DRAWING

A constructional example of the subject of the present invention is shown in a simplified manner in the drawing by means of which the invention will be explained in detail. In the drawing:

FIG. 1 shows a diagrammatic cross section through a rolling mill

FIG. 2 and FIG. 3 each show a plane view on to a working roll with pressure peaks represented, and FIG. 4 shows a diagram for the supply of pressure medium to two supporting devices which are situated opposite one another.

The illustrated rolling mill comprises two working rolls 1 and 2 which are supported each by a supporting roll 3 and 4 respectively. A long sheet of material 5 is guided through the pressure gap between the two working rolls 1 and 2. In the direction of movememnt of the sheet of material 5 and in the opposite direction to the said direction of movement, the two working rolls 1 and 2 are supported each by a series of hydrostatic supporting devices $6^1$, $6^2$, $6^3$ and $6^4$.

A supporting element of the series of supporting elements $6^3$ is shown in more detail. It comprises a stationary cylinder 7 and a bearing shoe 8 engaging in the said cylinder and having a hydrostatic pocket 9 facing towards the working roll 2. Leading into the cylinder 7 is a pressure conduit 10 and from the cylinder 7 a throttling bore not specifically designated, leads into the hydrostatic bearing pocket 9. When the cylinder 7 is supplied with pressure medium, the bearing shoe 8 presses against the working roll 2, leaving free a small gap for the outflowing pressure medium.

The working pressures of two supporting devices which are situated opposite one another, for example, the supporting devices $6^1$ and $6^2$, can be varied by amounts which correspond to an equal-magnitude force which acts in the material sheet plane. Such correspondence requires that the changes in the working pressures of the two supporting devices be related to each other in accordance with the inverse of the ratio of the areas of the pressure surfaces of the devices. Thus, in cases where those areas are equal, the working pressures must be changed by equal amounts.

In the condition illustrated in FIG. 2, four equal size pressure peaks 11, 12, 13 and 14 are represented for four supporting elements $6^1$ and four equal size pressure peaks 11', 12', 13' and 14' are represented for the four supporting devices $6^2$. The pressure 11, 12, 13 and 14 of the supporting devices $6^1$ are larger than the pressures 11', 12', 13' and 14' of the supporting devices $6^2$ by an amount corresponding substantially to the rolling force acting in the plane of the sheet of material. In other words, the pressures are so correlated with the sizes of the pressure surfaces of the supporting elements $6^1$ and $6^2$ to which they are applied that the two sets of opposed supporting elements apply to the associated working roll a net force which is substantially equal to and opposes the rolling force acting in the plane of material 5. As a result the bearings 15 for the end journals of the working roll 1 are substantially relieved of load.

In the condition shown in FIG. 3, the pressure peaks 11 and 11' and also the pressure peaks 13 and 13' are unaltered relatively to the condition shown in FIG. 2. On the other hand, the pressure peak 12 and the pressure peak 12' are smaller by the same amount $p_2$ than in the conditions shown in FIG. 2. It is assumed herein that the pressure surfaces of all of the supporting elements have the same size. Therefore, the equal reductions in the pressures 12 and 12' represented in FIG. 3 do not affect the net force developed on roll 1 by the supporting elements to which these pressures are applied. As a result, the support arrangement still serves to counterbalance the rolling force acting in the plane of the sheet material.

The pressure peak 14 and the pressure peak 14' in FIG. 3 are larger by an amount $p_1$ than the pressure peak 14 and the pressure peak 14' respectively in FIG. 2. Here too, the change in the pressure levels does not alter the difference between the pressures. Therefore, since the pressure areas of the supporting elements to which pressures 14 and 14' are applied are of equal size, these elements develop the same net force on roll 1 with the FIG. 3 pressures as they did with the FIG. 2 pressures.

As FIG. 4 indicates, the supporting devices $6^1$ are adapted to be connected alternately to conduits $L_0$, $L_1$ and $L_2$. Correspondingly the supporting devices $6^2$ can be connected alternately to conduits $R_0$, $R_1$ and $R_2$. The pressures in the conduits $L_0$ and $R_0$ correspond to the pressure peaks in FIG. 2. The pressures in the conduits $L_1$ and $R_1$ correspond to the pressures of the pressure peaks 14 and 14' in FIG. 3. The pressures in the conduits $L_2$ and $R_2$ correspond to the pressure peaks 12 and 12' in FIG. 3.

The device 16 ensures that two opposite supporting devices are always connected simultaneously to the conduits $L_0$ and $R_0$, or simultaneously to the conduits $L_1$ and $R_1$, or simultaneously to the conduits $L_2$ and $R_2$.

Although, as indicated above, the supporting forces applied to working roll 1 under the pressure conditions represented in FIGS. 2 and 3 are equal, the cooling effects in the two cases are different. In particular, cooling of the working roll 1 in the FIG. 3 case is smaller in the region of peaks 12, 12' and greater in the region of peaks 14, 14' than in the FIG. 2 case.

I claim:

1. A rolling mill for sheet material comprising a. two working rolls between which the sheet material is rolled;

b. two series of hydrostatic supporting devices supporting one of the working rolls, the devices of one series acting on the roll in the direction of movement of the sheet material and the devices of the other series acting on the roll in the opposite direction, c. the supporting devices of the two series forming oppositely situated pairs, and each supporting device co-acting with the surface of the roll to define a small gap through which hydraulic medium flows from the supporting device at a rate dependent upon the working pressure of the supporting device, such outflow of medium serving to exert a cooling effect on the adjacent region of the roll;

d. means for supplying hydraulic medium to the supporting devices at working pressures related to the sizes of the pressure surfaces of the supporting devices so that said pairs apply to to the roll net forces in the direction of rolling which act in opposition to the force exerted on the roll as an incident to rolling of the sheet material; and e. pressure selecting means associated with at least one of said pairs of supporting devices for selectively changing the working pressures of these two supporting devices by amounts which are related to each other in accordance with the inverse of the ratio of the sizes of the pressure areas of these particular devices, f. whereby the rates of flow of hydraulic medium through the associated gaps, and consequently the cooling effect on the adjacent roll region, may be varied while maintaining constant the net force developed on the roll by this pair of supporting devices.

2. A rolling mill as defined in claim 1 in which a. the supporting devices of said one pair have equal pressure areas; and b. said pressure selecting means is effective to change the working pressures of the supporting devices of said one pair equal amounts.

3. A rolling mill as defined in claim 1 in which the working pressures of the supporting devices are so chosen that the sum of said net forces equals said force exerted on the roll as an incident to rolling.

4. A rolling mill as defined in claim 1 in which a. said means for supplying hydraulic medium includes a first pair of sources of hydraulic medium at predetermined working pressures; and b. said pressure selecting means comprises at least one additional pair of sources of hydraulic medium at predetermined working pressures, and selecting means for simultaneously connecting the two devices of said one pair of supporting devices with either the sources of said first pair or with the sources of said additional pair.

* * * * *